US012031398B2

(12) United States Patent
Alharbi et al.

(10) Patent No.: US 12,031,398 B2
(45) Date of Patent: Jul. 9, 2024

(54) SELF-CLEANING FILTER SUB AND METHODS OF USE

(71) Applicant: SAUDI ARABIAN OIL COMPANY, Dhahran (SA)

(72) Inventors: Atallah N. Alharbi, Dammam (SA); Abdullah Al-Dossary, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/056,595

(22) Filed: Nov. 17, 2022

(65) Prior Publication Data

US 2024/0167354 A1 May 23, 2024

(51) Int. Cl.
*E21B 27/00* (2006.01)
*E21B 21/10* (2006.01)

(52) U.S. Cl.
CPC ..... *E21B 27/005* (2013.01); *E21B 21/103* (2013.01); *E21B 2200/05* (2020.05)

(58) Field of Classification Search
CPC ..... E21B 43/10; E21B 21/08; E21B 43/086; E21B 2200/05; E21B 27/005; E21B 21/103
See application file for complete search history.

(56) References Cited

U.S. PATENT DOCUMENTS

| | | | | |
|---|---|---|---|---|
| 3,123,157 | A * | 3/1964 | Graham | E21B 27/005 175/312 |
| 9,416,626 | B2 * | 8/2016 | Xu | E21B 27/005 |
| 11,421,494 | B1 * | 8/2022 | Al Bayat | E21B 27/005 |
| 2021/0215021 | A1 * | 7/2021 | Bonhomme | E21B 43/086 |

* cited by examiner

*Primary Examiner* — Brad Harcourt
(74) *Attorney, Agent, or Firm* — Vorys, Sater, Seymour and Pease LLP

(57) ABSTRACT

A filter sub for a wellbore drilling system includes a filter having an uphole end for receiving a drilling fluid, and a downhole end opposite the uphole end, the filter defining a plurality of apertures through which the drilling fluid flows out of the filter, each aperture exhibiting a size that retains debris of a predetermined size within the filter, and a flapper pivotably attached to the filter at the downhole end with an actuatable hinge. The flapper is pivotable at the actuatable hinge between a closed position, where the flapper occludes the downhole end and thereby prevents debris accumulated within the filter from escaping the filter, and an open position, where the flapper exposes the downhole end and thereby allows the debris to escape the filter and be discharged from the filter sub.

20 Claims, 5 Drawing Sheets

SELF-CLEANING FILTER SUB AND METHODS OF USE

FIELD OF THE DISCLOSURE

The present disclosure relates generally to the drilling of boreholes and, more particularly, to self-cleaning filter subs within a drill string.

BACKGROUND OF THE DISCLOSURE

Drilling fluids are used in the drilling of subterranean boreholes, and serve the purpose of lubrication for the drill string, cooling of the downhole assembly and drill bit, suppressing downhole formation pressure, and flushing away drill cuttings created during drilling. A pump (e.g., a mud pump) circulates the drilling fluid downhole through the interior of the drill string and ultimately through one or more orifices in the drill bit. Along with cuttings and other debris, the drilling fluid is then circulated back to the surface via an annulus defined between the drill string and the inner wall of the borehole. At the surface, the recirculated or spent drilling fluid exits the annulus and is conveyed to one or more fluid processing units to be filtered and cleaned. A "cleaned" drilling fluid is then recirculated back into the drill string and conveyed to the drill bit.

Circulating the drilling fluid back into the drill string can cause damage to downhole equipment and tools if the drilling fluid is not properly cleaned and filtered. As such, the removal of cuttings and debris is vital to protect the drill string as well as sensitive tooling that may be present within the downhole assembly. To address this issue, various techniques are used for removing the cuttings and debris from the drilling fluid, such as incorporating surface separators and screens in the surface cleaning units, or by including retrievable filtering tools in the drill string that can be removed and cleaned periodically.

The use of surface separators and screens may be unable to fully clean the spent drilling fluid due to the excessive volume of drilling fluid returns and the size of the cuttings. Consequently, these cuttings and debris may be inadvertently reintroduced downhole. Similarly, the retrievable filtering tools may be incompatible with certain drill string layouts, may fail during retrieval and spill cuttings back into the drill string, and also require the cessation of drilling to remove and clean. As such, improved techniques and tooling are necessary for the sufficient removal of debris from the drilling fluid while maintaining drilling activities without unnecessary downtime.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a filter sub for a wellbore drilling system includes a filter having an uphole end for receiving a drilling fluid, and a downhole end opposite the uphole end, with the filter defining a plurality of apertures through which the drilling fluid flows out of the filter, and each aperture exhibiting a size that retains debris of a predetermined size within the filter. The filter sub further includes a flapper pivotably attached to the filter at the downhole end with an actuatable hinge. The flapper is pivotable at the actuatable hinge between a closed position, where the flapper occludes the downhole end and thereby prevents debris accumulated within the filter from escaping the filter, and an open position, where the flapper exposes the downhole end and thereby allows the debris to escape the filter and be discharged from the filter sub.

In another embodiment, a method includes conveying a drilling fluid into a drill string extended into a wellbore, with a drill bit being arranged at a distal end of the drill string and a filter sub being arranged in the drill string uphole from the drill bit. The filter sub includes a filter having uphole and downhole ends and defining a plurality of apertures, each aperture exhibiting a size that retains debris of a predetermined size within the filter, and a flapper pivotably attached to the filter at the downhole end with an actuatable hinge. The method further includes receiving the drilling fluid at the uphole end, flowing at least a portion of the drilling fluid out of the filter through the plurality of apertures while simultaneously retaining the debris within the filter, maintaining the flapper in a closed position and thereby occluding the downhole end and preventing the debris accumulated within the filter from escaping the filter, pivoting the flapper with the actuatable hinge to an open position and thereby exposing the downhole end, and discharging the debris accumulated within the filter from the filter sub and into an annulus defined between the drill string and an inner wall of the wellbore.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
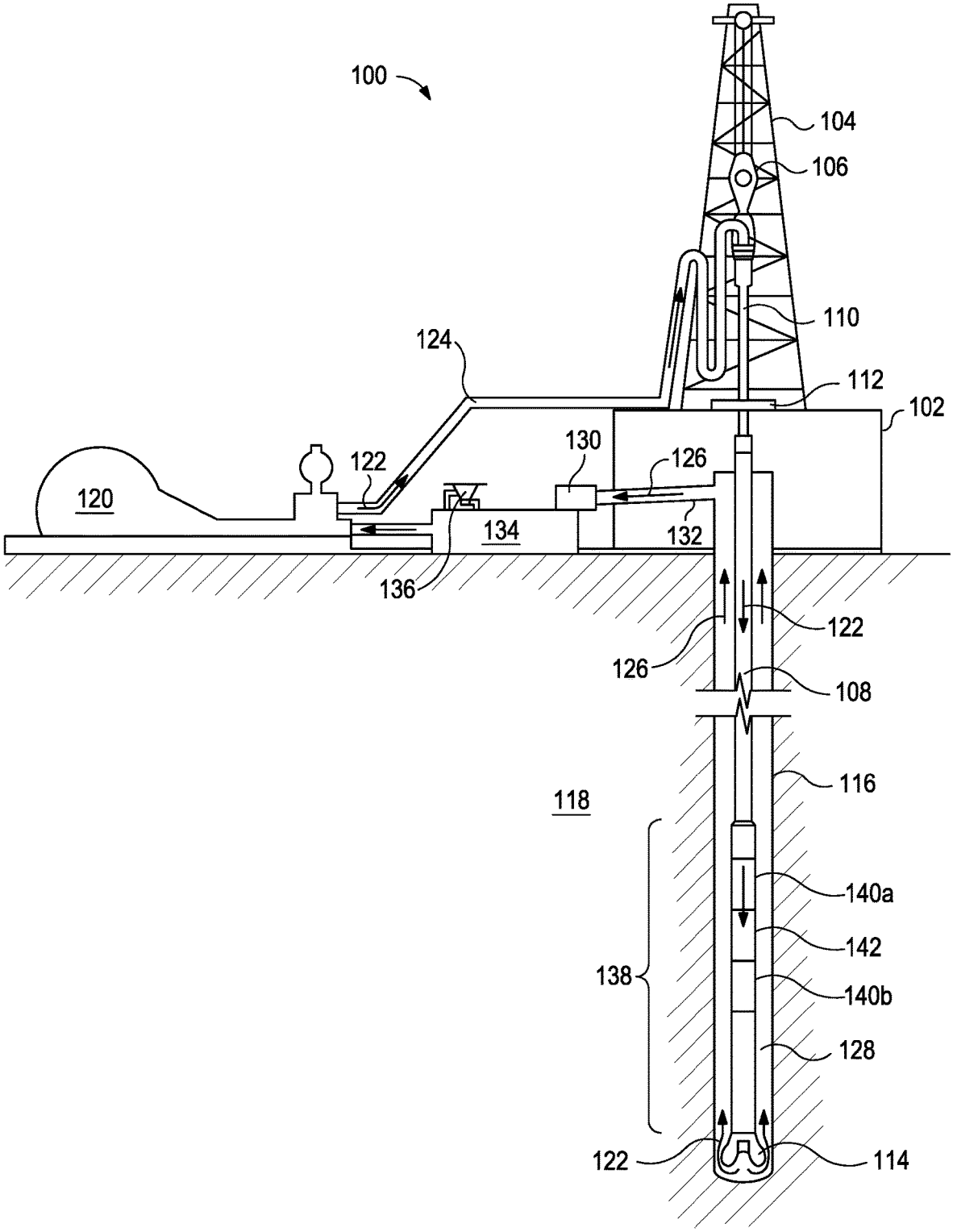
FIG. 1 is a schematic view of an example drilling system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the drilling of boreholes and, more particularly, to self-cleaning filter subs included within a drill string. The self-cleaning filter subs described herein may be used during any drilling operation to reduce the high non-productive times which accumulate due to the plugging of conventional filter subs currently experienced in the art. This non-productive time may be attributed to the travel time required when tripping a drill string out of a borehole, changing the filter sub at a surface location, reassembling the filter sub, and running the drill string back into the hole. Through the use of the self-cleaning filter sub of the present disclosure, the necessity of these times may be eliminated with the self-cleaning mechanism described herein.

Referring to FIG. 1, illustrated is an example drilling system 100 that may employ the principles of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling system 100 may include a drilling platform 102 that supports a derrick 104 having a traveling block 106 for raising and lowering a drill string 108. The drill string 108 may include, but is not limited to, a drill pipe and coiled tubing. A kelly 110 supports the drill string 108 as it is lowered through a rotary table 112. A drill bit 114 is attached to the distal end of the drill string 108 and is driven either by a downhole motor or via rotation of the drill string 108 from the drilling platform 102. As the bit 114 rotates, it creates a borehole 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The spent drilling fluid 126 is then circulated back to the surface via an annulus 128 defined between the drill string 108 and the walls of the borehole 116. At the surface, the recirculated or spent drilling fluid 126 exits the annulus 128 and may be conveyed to one or more fluid processing unit(s) 130 via an interconnecting flow line 132. After passing through the fluid processing unit(s) 130, a "cleaned" drilling fluid 122 is deposited into a nearby retention pit 134 (i.e., a mud pit). One or more chemicals, fluids, or additives may be added to the drilling fluid 122 via a mixing hopper 136 communicably coupled to or otherwise in fluid communication with the retention pit 134.

The drilling system 100 may further include a bottom hole assembly (BHA) 138 arranged in the drill string 108 at or near the drill bit 114. The BHA 138 may include any of a number of downhole tooling subs 140*a,b* which may include formation evaluation sensors and directional sensors, such as measuring-while-drilling and/or logging-while-drilling tools, float subs, lift subs, or any other functional sub-assemblies to aid in drilling operations. The BHA 138 may further include one or more filter subs 142 (one shown) installed within the drill string 108 alongside the various downhole tooling subs 140*a,b*. While the filter sub 142 and the additional downhole tooling subs 140*a,b* may be arranged in any order downhole, the filter sub 142 may be more effective at protecting the drill string 108 when closer to the drill bit 114 actively drilling the borehole 116.

While the fluid processing unit(s) 130 may facilitate the removal of debris and cuttings from the returned drilling fluid 126 near the drilling platform 102, the filter sub 142 may protect the drill string 108 from actively circulating any debris or cuttings that were not removed by the fluid processing unit 130. Consequently, the filter sub 142 may be configured to protect against the failure of the fluid processing unit(s) 130 and help remove any additional cuttings or debris that may be inadvertently re-introduced into the drill string 108.

Conventional filter subs will get clogged over time as the debris accumulates, thus requiring the drill string 108 to be tripped out of the borehole 116 to clean the filter subs. After cleaning the filter sub, the drill string 108 would then be tripped back into the borehole 116 to resume operations. To avoid this time-consuming and costly downtime, the filter sub(s) 142 described herein may be configured to be cleaned autonomously while downhole within the borehole 116 and during active operation of the drilling system 100.

Figure 2:
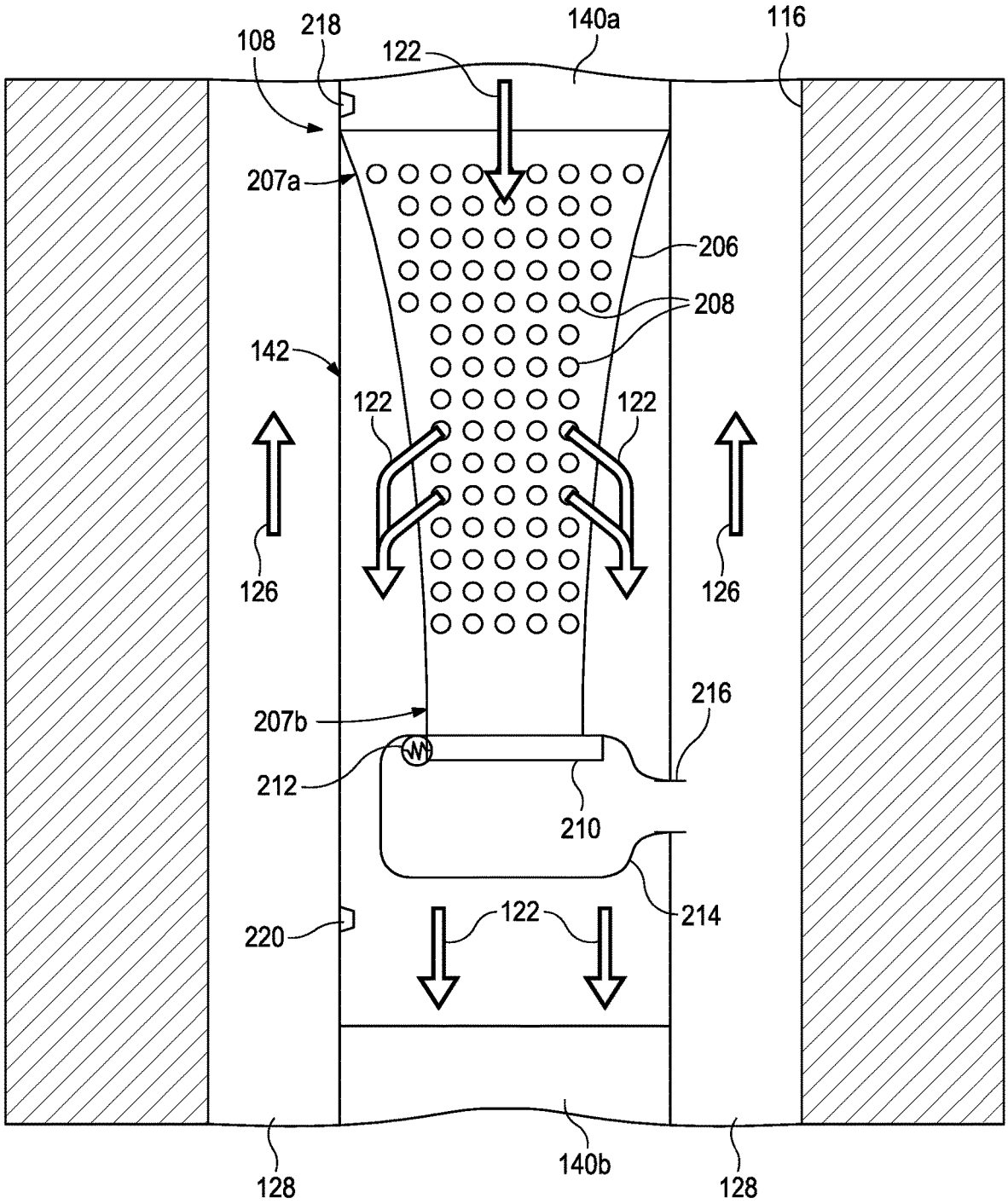
FIG. 2 is a cross-sectional side view of the filter sub installed within the borehole.

FIG. 2 is a cross-sectional side view of an example of the filter sub 142 of FIG. 1, according to one or more embodiments. In FIG. 2, the adjacent various downhole tooling subs 140*a,b* may be seen as part of the drill string 108. As the drill string 108 operates, drilling fluid 122 may flow within the drill string 108 down to the drill bit 114 (FIG. 1) at the bottom of the drill string 108. Upon reaching the drill bit 114, the drilling fluid 122 is ejected out of the drill bit 114 to lubricate and cool the drill bit 114, and the returning or "spent" drilling fluid 126 circulates back to the drilling platform 102 (FIG. 1) within the annulus 128 defined between the drill string 108 and the inner wall of the borehole 116. Any cuttings and debris generated during the drilling process are entrained within the spent drilling fluid 126 and returned to the drilling platform 102 simultaneously.

As the drilling fluid 122 circulates through the drill string 108, it eventually reaches and circulates through the filter sub 142, which is configured to filter the drilling fluid 122 by retaining any foreign bodies (e.g., debris, prior borehole cuttings, metal fragments, etc.) that may be entrained within the drilling fluid 122. If the drilling fluid 122 is left unfiltered, the debris may damage the drill bit 114 (FIG. 1) or otherwise cause erosion damage to equipment downstream from the filter sub 142.

As illustrated, the filter sub 142 includes a filter screen or "filter" 206 having a first or "uphole" end 207*a* and a second or "downhole" end 207*b*. The drilling fluid 122 is circulated through the drill string 108 and conveyed into the filter 206 at the uphole end 207*a*. In some embodiments, as illustrated, the filter 206 may be generally conical in shape to accommodate the incoming flow at the uphole end 207*a* while tapering towards the downhole end 207*b*. In other embodiments, however, the filter 206 may exhibit other cross-sectional shapes, without departing from the scope of the disclosure. In some embodiments, as illustrated, the filter 206 defines a plurality of apertures 208 exhibiting a size sufficient to retain (trap) debris of a predetermined size entrained in the drilling fluid 122, while allowing the remaining portion of the drilling fluid 122 to pass therethrough. Accordingly, filtered drilling fluid 122 is discharged from the filter 206 via the apertures 208 and is then circulated further downstream until reaching the drill bit 114 (FIG. 1).

Figure 4:
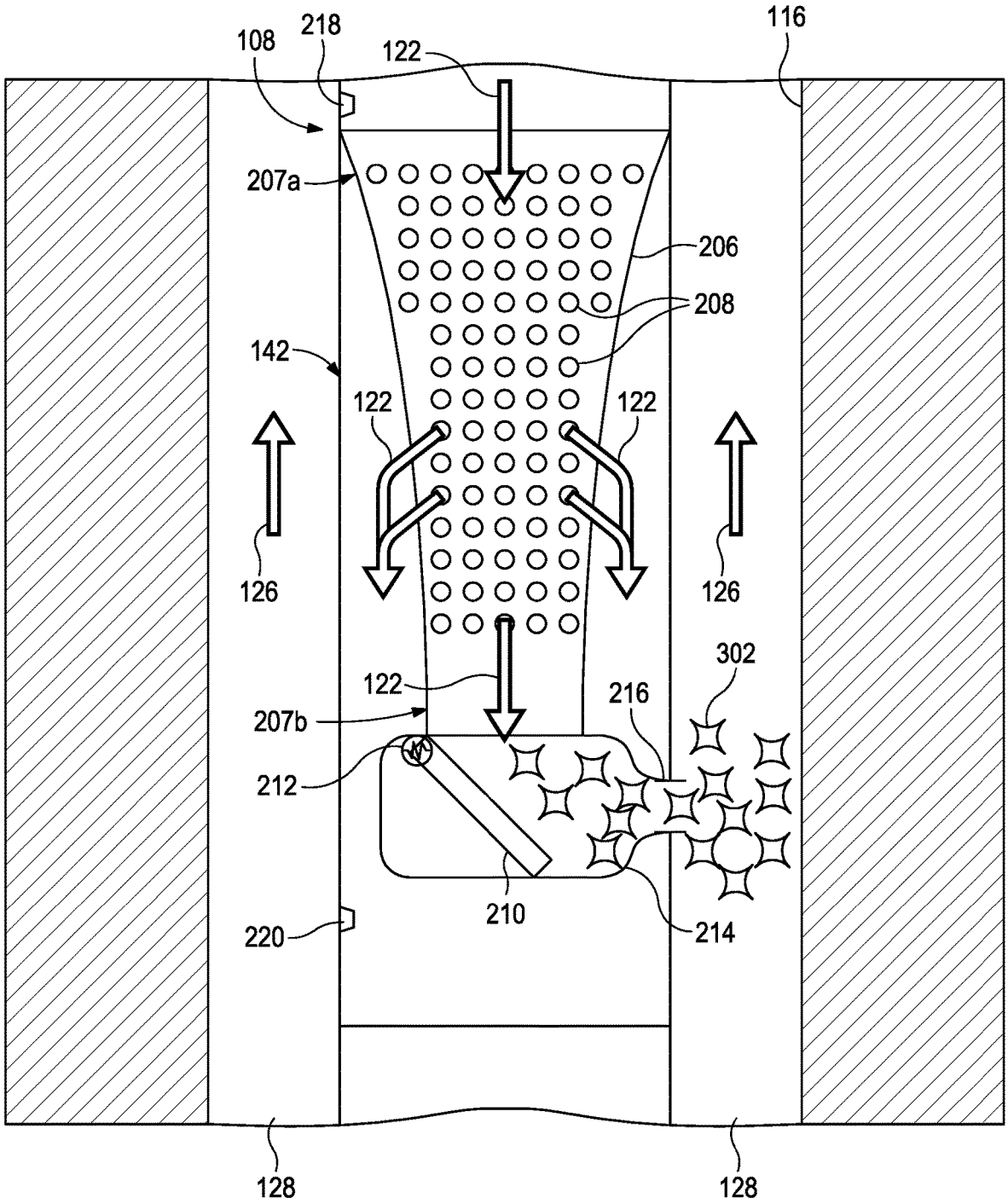

In the illustrated embodiment, the filter sub 142 may include a flapper valve or "flapper" 210 arranged within the filter sub 142 at or near the downhole end 207*b*. The flapper 210 is pivotably attached to the filter 206 via an actuatable hinge 212 that allows the flapper 210 to pivot between a first or "closed" position, as shown in FIG. 2, and a second or "open" position, as shown in FIG. 4. When in the closed position, the flapper 210 occludes the downhole end 207*b* and thereby prevents debris accumulated within the filter 206 from escaping the filter 206. In contrast, when in the open position, the flapper 210 exposes the downhole end 207*b* thereby allows the debris to escape the filter 206. Until moved to the open position the actuatable hinge 212 may maintain the flapper 210 in the default, closed position, thus preventing the drilling fluid 122 and any accumulated debris from exiting the filter 206 at the downhole end 207*b*. Once the flapper 210 is moved to the open position, however, a portion of the drilling fluid 122 and any debris accumulated within the filter 206 may be discharged into the annulus 128 defined between the drill string 108 and the inner walls of the borehole 116 to be circulated back to the drilling platform 102 (FIG. 1) to with the spent drilling fluid 126. Accordingly, the downhole end 207*b* of the filter 206 may be considered to be in fluid communication with the annulus 128.

In some embodiments, a discharge chamber 214 may be arranged at the downhole end 207*b* of the filter 206 and in fluid communication with the annulus 128. In such embodiments, the flapper 210 may be positioned within the discharge chamber 214 and actuation (movement) of the flapper 210 to the open position will allow a portion of the drilling fluid 122 and any debris accumulated within the filter 206 to be discharged into (flowed into) the discharge chamber 214. In some embodiments, the discharge chamber 214 may be in direct fluid communication with the annulus 128. In such embodiments, any fluid or debris entering the discharge chamber 214 will be directly deposited into the annulus 128. In at least one embodiment, however, a discharge port 216 may be provided on the sidewall of the filter sub 142 to provide fluid communication between the annulus 128 and the interior of the discharge chamber 214.

Actuation of the flapper 210 may be based on a pressure differential experienced between the interior and exterior of the filter 206. As debris builds within the filter 206, and the drilling fluid 122 is continuously pumped through the filter 206, the pressure differential increases and will eventually reach a limit where the flapper 210 is actuated. In some embodiments, for example, the actuatable hinge 212 may comprise a torsion spring with a predetermined spring force. Once the pressure differential exceeds the spring force of the torsion spring, the pressure acting on the flapper 210 will cause the actuatable hinge 212 to operate and move the flapper 210 to the open position and discharge a portion of the drilling fluid 122 and any debris accumulated within the filter 206. In some embodiments, the centrifugal force generated by the rotation of the drill string 108 may help remove debris from the filter 206. Moreover, the fluid pressure of the spent drilling fluid 126 within the annulus 128 may generate a Venturi effect that draws the low pressure debris out of the downhole end 207*b* of the filter 206 and into the annulus 128.

In other embodiments, the actuatable hinge 212 may comprise or contain a motor which receives a signal to move the flapper 210 from the closed position to the open position when the pressure differential reaches a predetermined limit. In such embodiments, a first sensor 218 may be arranged to measure a pressure uphole from the filter 206, while a second sensor 220 may be arranged downhole from the filter 206. The first and second sensors 218, 220 may comprise pressure sensors, (e.g., resistive pressure sensors), and may be configured to send pressure measurements or signals (voltages) representative of pressures, to a processor in communication with the motor of the actuatable hinge 212. When the predetermined limit of the pressure differential is reached between the location uphole from the filter 206 and the location downhole from the filter 206 due to clogging, the processor may signal for the motor of the actuatable hinge 212 to move the flapper 210 and release the contents of the filter 206, as previously described.

Figure 3:
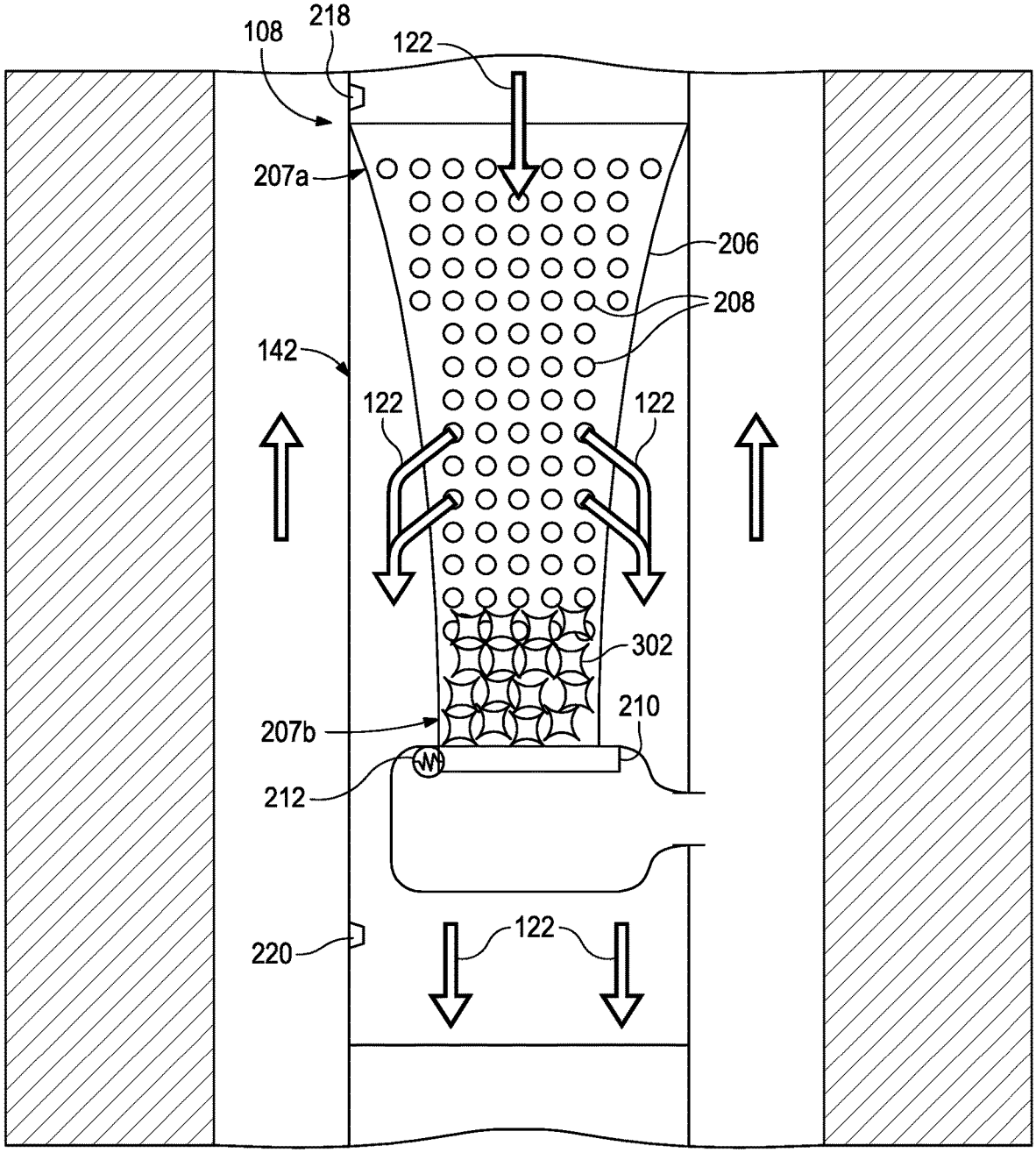
FIGS. 3 and 4 depict example, progressive operation of the filter sub of FIG. 2, according to one or more embodiments.

Example operation of the filter sub 142 will now be provided with reference to FIGS. 3 and 4, which depict a series of cross-sectional side views of the filter sub 142, according to one or more embodiments.

In FIG. 3, the drilling fluid 122 is being conveyed into the filter sub 142 via the drill string 108. A portion of the drilling fluid 122 may exit the filter 206 via the apertures 208 and is then circulated further downstream along the drill string 108. Over time, debris 302 will begin to accumulate within the filter 206 at the downhole end 207*b*. The debris 302 may comprise foreign material entrained within the drilling fluid 122 and having a size larger than the apertures 208, thus being trapped within the filter 206. The debris 302 is retained within the filter 206 while the remainder of the drilling fluid 122 exits through the apertures 208.

As the debris 302 accumulates within the filter 206, the apertures 208 will progressively become clogged, thus increasing a pressure within the filter 206 and the upstream portions of the drill string 108. The pressure will continue to increase as the flow of the drilling fluid 122 continues and additional debris 302 is deposited within the filter 206. As the clogging of the apertures 208 increases with the accumulation of more debris 302, the pressure differential between the interior and exterior of the filter 206 will correspondingly increase. The pressure may increase until reaching the predetermined pressure threshold or limit. In embodiments where the actuatable hinge 212 comprises a torsion spring, once the pressure differential reaches a predetermined limit, the force of the pressure may overcome the spring force of the torsion spring, which allows the flapper 210 to pivot to the open position. In embodiments where the actuatable hinge 212 includes or comprises a motor, however, once the pressure differential reaches the predetermined limit, as measured by the first and second sensors 218, 220, the motor of the actuatable hinge 212 will be actuated to pivot the flapper 210 to the open position.

In FIG. 4, the flapper 210 has been actuated (pivoted) to the open position. With the flapper 210 in the open position, the debris 302 accumulated within the filter 206 may exit the filter 206 at the downhole end 207*b* to be received within the annulus 128. In some embodiments, as illustrated, the debris 302 may exit the filter 206 into the discharge chamber 214, which is in fluid communication with the annulus 128. And in at least one embodiment, the debris 302 may access the annulus 128 from the discharge chamber 214 via the discharge port 216 provided on the sidewall of the filter sub 142. Once in the annulus 128, the debris 302 may be entrained by the spent drilling fluid 126 and flowed to the drilling platform 102 (FIG. 1) with the spent drilling fluid 126 for processing.

As briefly mentioned above, evacuation of the debris 302 from within the filter 302 may be aided by the centrifugal force generated by the rotation of the drill string 108. Moreover, the fluid pressure of the spent drilling fluid 126 within the annulus 128 may generate a Venturi effect that draws the debris 302 and a portion of the drilling fluid 122 out of the filter 206 and into the annulus 128.

As the debris 302 unclogs from the apertures 208 and the filter 206 empties, the pressure differential may normalize. In embodiments where the actuatable hinge 212 comprises a torsion spring, the normalized pressure differential will allow the actuatable hinge 212 to return the flapper 210 back to the closed position. In embodiments where the actuatable hinge 212 is operated by a motor, normalizing the pressure differential, as determined by measurements obtained by the sensors 218, 220, will cause the motor to pivot the flapper 210 back to the closed position. Accordingly, as the pressure differential normalizes, the actuatable hinge 212 may return the flapper 210 to the original position, in which the filter 206 and the discharge chamber 214 are again isolated, and the process of the accumulation and release of debris 302 may begin again.

Figure 5:
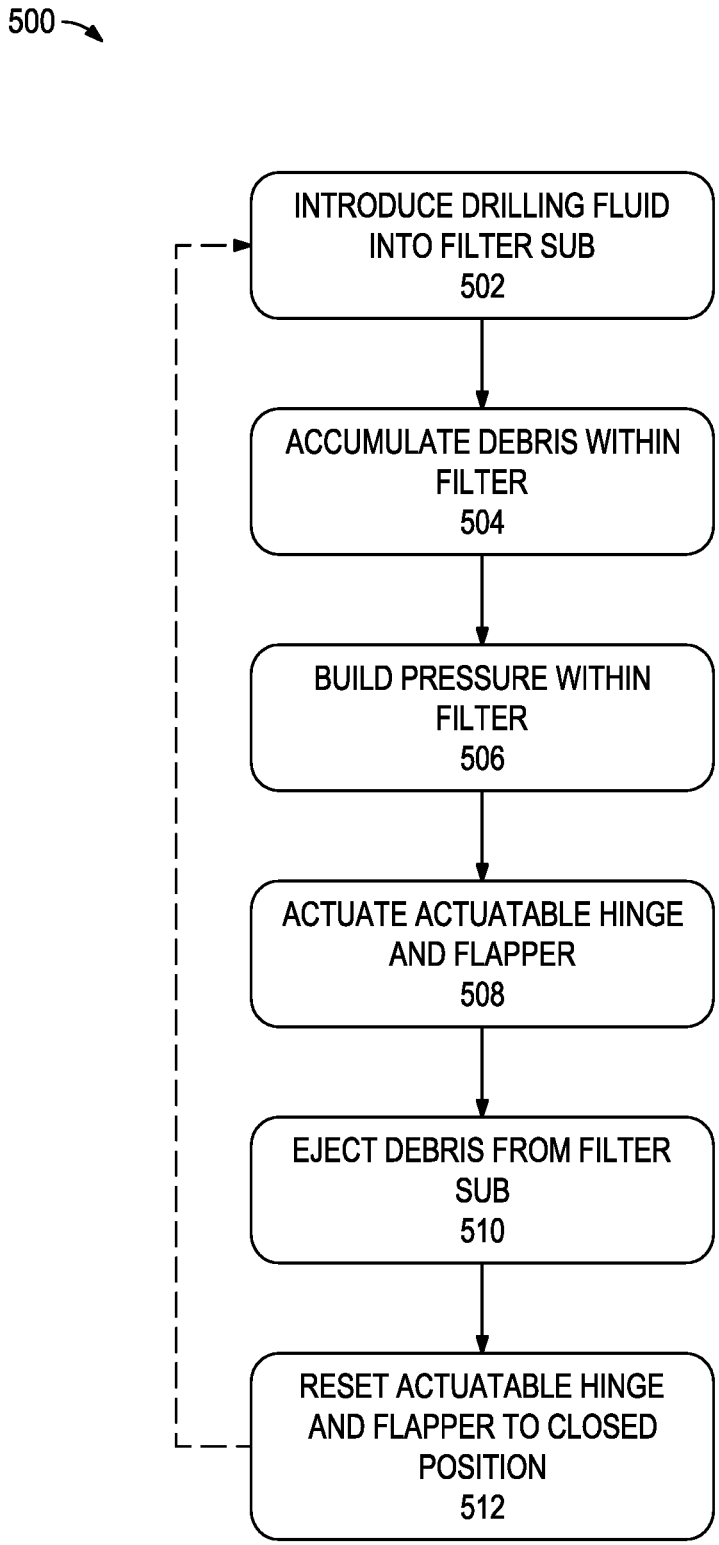
FIG. 5 is a schematic flowchart of an example method for filtering debris with a filter sub in accordance with the principles of the present disclosure.

FIG. 5 is a schematic flowchart of an example method 500 for filtering debris (e.g., the debris 302) with a filter sub (e.g., the filter sub 142). The method 500 may begin at 502 with the introduction of a drilling fluid (e.g., the drilling fluid 122) into the filter sub during a drilling operation. The drilling fluid introduced at 502 may include debris that has been reintroduced to the system from the spent drilling fluid (e.g., the spent drilling fluid 126), or debris that has inadvertently been introduced to the system at a surface location (e.g., the drilling platform 102). At 504, the drilling fluid may flow through the apertures of the filter (e.g., the apertures 208 and the filter 206), but the debris entrained in the drilling fluid may accumulate within the filter. The drilling fluid may exit the filter through the apertures and enter the remainder of the filter sub, such that the filtered drilling fluid may continue through the drill string (e.g., the drill string 108) towards the drill bit (e.g., the drill bit 114).

At 506, a pressure may build within the filter as the debris accumulates within the filter. As the apertures clog, the drilling fluid has less area to flow through while being provided at the same flowrate, thus increasing the fluid pressure within the filter sub. The pressure may continue to increase within the filter until a predetermined pressure threshold is reached. At 508, an actuatable hinge and flapper (e.g., the actuatable hinge 212 and the flapper 210) may open into a discharge chamber (e.g., the discharge chamber 214) in response to the predetermined pressure threshold being reached. The actuatable hinge may actuate with a valve spring set to move at a prescribed pressure, or may be actuated by a motor connected to a processor which is signaled based upon a pressure difference determined between a sensor uphole from the filter (e.g., the first sensor 218) and a sensor downhole from the filter (e.g., the second sensor 220).

Upon the opening of the actuatable hinge at 508, the debris accumulated within the filter may be released into the discharge chamber along with a portion of the actively flowing drilling fluid. As the debris moves from the filter into the discharge chamber, the debris may be ejected from the filter sub at 510. The discharge chamber may include a discharge port (e.g., the discharge port 216) that places the discharge chamber in fluid communication with the annulus (e.g., the annulus 128) between the drill string and the borehole. The debris may be ejected into the annulus at 510, and may be aided by the centrifugal force generated by the rotation of the drill string, as well as the Venturi effect of the drilling fluid migrating through the annulus.

As the debris enters the annulus between the drill string and the borehole, the spent drilling fluid may carry the debris back to the surface location and away from the drill bit. Simultaneously, at 512, the actuatable hinge and flapper may be reset to the closed position as the pressure equalizes within the drill string. As the pressure decreases below the previously discussed threshold, the closing of the flapper may indicate the completion of the cleaning process. Thus, after the closing of the flapper, the method may begin again at 502 with the introduction of additional drilling fluid into the filter sub.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A filter sub for a wellbore drilling system, comprising:

a filter having an uphole end for receiving a drilling fluid, and a downhole end opposite the uphole end, the filter defining a plurality of apertures through which the drilling fluid flows out of the filter, each aperture exhibiting a size that retains debris of a predetermined size within the filter; and a flapper pivotably attached to the filter at the downhole end with an actuatable hinge, wherein the flapper is pivotable at the actuatable hinge between a closed position, where the flapper occludes the downhole end and thereby prevents debris accumulated within the filter from escaping the filter, and an open position, where the flapper pivots away from the filter to expose the downhole end and thereby allows the debris to escape the filter and be discharged from the filter sub.

2. The filter sub of claim 1, wherein the debris discharged from the filter sub is receivable within an annulus defined between the filter sub and an inner wall of a borehole where the filter sub is operating.

3. The filter sub of claim 2, further comprising a discharge member arranged at the downhole end of the filter sub and in fluid communication with the annulus, wherein, when the flapper is pivoted to the open position, the debris is discharged into the discharge member and conveyed to the annulus.

4. The filter sub of claim 3, wherein the flapper is positioned within the discharge chamber.

5. The filter sub of claim 3, further comprising a discharge port provided on a sidewall of the filter sub, wherein the discharge port facilitates fluid communication between the discharge member and the annulus.

6. The filter sub of claim 1, wherein the actuatable hinge comprises a torsion spring.

7. The filter sub of claim 6, wherein the torsion spring exhibits a spring force, and wherein the torsion spring maintains the flapper in the closed position until a pressure differential within the filter exceeds the spring force.

8. The filter sub of claim 1, wherein the actuatable hinge comprises a motor operable to pivot the flapper between the closed and open positions.

9. The filter sub of claim 8, further comprising:

a first sensor configured to monitor a pressure uphole from the filter and thereby obtain a first pressure measurement; and a second sensor configured to monitor a pressure downhole from the filter and thereby obtain a second pressure measurement, wherein the motor is operated to pivot the flapper to the open position when a pressure differential between the first and second pressure measurements reaches a predetermined limit.

10. The filter sub of claim 9, the motor is operated to pivot the flapper back to the closed position when the pressure differential falls below the predetermined limit.

11. The filter sub of claim 1, wherein the filter is conical in shape to accommodate receiving the drilling fluid at the uphole end and tapering towards the downhole end.

12. The filter sub of claim 1, wherein the debris enters the filter sub through the uphole end within the drilling fluid.

13. A method, comprising:

conveying a drilling fluid into a drill string extended into a wellbore, a drill bit being arranged at a distal end of the drill string and a filter sub being arranged in the drill string uphole from the drill bit, the filter sub including:

a filter having uphole and downhole ends and defining a plurality of apertures, each aperture exhibiting a size that retains debris of a predetermined size within the filter; and a flapper pivotably attached to the filter at the downhole end with an actuatable hinge;

receiving the drilling fluid at the uphole end;

flowing at least a portion of the drilling fluid out of the filter through the plurality of apertures while simultaneously retaining the debris within the filter;

maintaining the flapper in a closed position and thereby occluding the downhole end and preventing the debris accumulated within the filter from escaping the filter;

pivoting the flapper with the actuatable hinge to an open position and thereby exposing the downhole end; and discharging the debris accumulated within the filter from the filter sub and into an annulus defined between the drill string and an inner wall of the wellbore.

14. The method of claim 13, further comprising pivoting the flapper to the closed position after discharging the debris.

15. The method of claim 13, wherein pivoting the flapper with the actuatable hinge comprises autonomously operating the actuatable hinge in response to a pressure differential acting on the flapper.

16. The method of claim 13, wherein the actuatable hinge includes a motor, and wherein pivoting the flapper with the actuatable hinge comprises:

monitoring a pressure uphole from the filter with a first sensor and thereby obtaining a first pressure measurement;

monitoring a pressure downhole from the filter with a second sensor and thereby obtaining a second pressure measurement;

operating the motor to pivot the flapper to the open position when a pressure differential between the first and second pressure measurements reaches a predetermined limit; and operating the motor to pivot the flapper back to the closed position when the pressure differential falls below the predetermined limit.

17. The method of claim 13, wherein discharging the debris accumulated within the filter from the filter sub and into the annulus comprises:

receiving debris within a discharge member arranged at the downhole end of the filter sub and in fluid communication with the annulus; and discharging the debris into the annulus from the discharge member.

18. The method of claim 13, further comprising aiding a discharge of the debris accumulated within the filter by at least one of:

a centrifugal force generated by rotation of the drill string; and drawing the debris out of the filter using a Venturi effect generated by a fluid pressure of spent drilling fluid circulated within the annulus.

19. The method of claim 13, wherein discharging the debris is performed during active operation of the drill string.

20. The method of claim 13, wherein pivoting the flapper to the open position includes pivoting the flapper away from the filter.

* * * * *